United States Patent [19]

Scholle

[11] 3,977,569

[45] Aug. 31, 1976

[54] DRINK DISPENSER

[75] Inventor: William R. Scholle, Compton, Calif.

[73] Assignee: Scholle Corporation, Northlake, Ill.

[22] Filed: Oct. 14, 1975

[21] Appl. No.: 621,746

[52] U.S. Cl. ..... 222/105; 222/143
[51] Int. Cl.[2] ..... B67D 35/56; B67D 5/60
[58] Field of Search ..... 222/105, 95, 143

[56] References Cited

UNITED STATES PATENTS

| | | | |
|---|---|---|---|
| 3,026,005 | 3/1962 | Cook | 222/105 |
| 3,448,897 | 6/1969 | Sterling | 222/105 |

*Primary Examiner*—Allen N. Knowles
*Assistant Examiner*—Hadd Lane
*Attorney, Agent, or Firm*—Gary, Juettner

[57] ABSTRACT

A barrel shaped drink dispenser comprises two connectable and separable halves forming a barrel-like shell containing a drink or beverage filled bag. One of the halves has an opening for receiving a spout for emptying the bag, and at least one of the halves has an extending leg element for preventing the shell from rolling about when layed on its side. Preferably, each of the halves is provided with a leg element and is adapted to be engaged by a coin or the like to facilitate separating the halves. The configuration of each of the halves is such to permit stacking of the disassembled halves for ease of storage and shipment.

1 Claim, 6 Drawing Figures

DRINK DISPENSER

BACKGROUND OF THE INVENTION

This invention relates to dispensing containers and more particularly to the type container used to house a flexible liquid or fluent filled bag.

Usually containers of this type are made of corrugated paper and are generally rectangular in shape. While such containers are functional, they lack asthetic appeal, and there is a lack of consumer acceptance for certain products, such as spirits, packaged in this manner, spirits being more traditionally packaged in bottles, kegs or small barrels. However, such traditionally shaped enclosure is not readily usable with a liquid filled bag because, usually, there is only a small opening in the enclosure, making it difficult to install such bag therein.

SUMMARY OF THE INVENTION

The drink dispenser of the present invention retains the advantages of the traditional shape and the dispensing bag concept, and comprises a barrel-shaped shell formed by a pair of halves connectable to form a closure for a fluent filled dispenser bag. The halves are separable to facilitate installing the bag and reuse of the shell, as by refilling or for other purposes. The halves are cup shaped, each have an open and closed end, so that the fluent filled bag can be readily positioned within the halves. The halves have locking means on their adjacent open ends and can be joined to form a protective closure for the bag. Further, the halves are provided with leg elements which prevent the barrel-shaped shell from rolling about when layed on its side and, also, have means thereon for receiving a tool, such as a coin, to facilitate separation of the halves for reuse.

One object of the present invention is to provide a barrel-shaped container for a dispenser having a fluent filled bag.

Another object of the present invention is to provide a container of the foregoing type which has securable and separable halves for facilitating installation and removal of the fluent bag.

Another object of the present invention is to provide a container of the foregoing type having locking means for securing the halves together.

Another object of the present invention is to provide a container of the foregoing type having means for separating the halves to facilitate their reuse.

Another object of the present invention is to provide a container of the foregoing type which will not roll about when layed on its side.

Another object of the present invention is to provide such a container formed of economic plastic material.

These and other objects of the present invention will become apparent from the following written description and the accompanying figures of the drawing, wherein:

DESCRIPTION OF THE PREFERRED EMBODIMENTS

Figure 1:
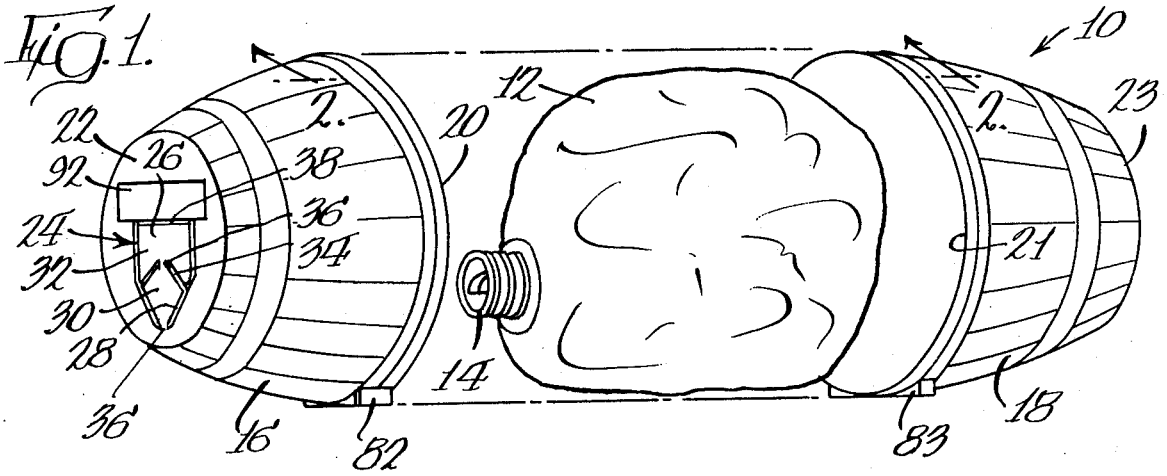
FIG. 1 is an exploded perspective view of a barrel-shaped dispenser of the present invention for use with a fluent filled bag.

In FIG. 1 is illustrated a barrel-shaped container or shell 10 of the present invention which is usable with a fluent filled bag 12 containing spirits, such as wine. The bag 12 is made of a flexible material, such as polyethylene and has means for filling the bag and means for dispensing the contents thereof, such as a tap or spout 14. For shipping and storage convenience the bag 12 and spout 14 are contained within the shell 10, but the spout 14 may later be positioned on the outside of the shell for use, as will be described.

The shell 10 is keg or barrel-shaped and comprises two joined, but separable, portions or halves, a front half 16 and a rear half 18. The halves 16 and 18 are of about the same length, being about half the axial length of the barrel (approximately 10¼ inches), have relatively large diameter (approximately 7¼ inches) open ends 20 and 21 and smaller diameter (approximately 5 inches) closed ends 22 and 23. The halves 16 and 18 are relatively thin walled, being a maximum of about one-tenth of an inch at its thickest, that being at the mid band area adjacent ends 20 and 21. This construction permits the halves 16 and 18 to be stacked, one within the other, for convenient shipment and storage by the manufacturer of the shell halves to the spirits distiller prior to the installation of the bag 12. Also, the size of the halves 16 and 18 are such that, when assembled, a one gallon size flexible bag 12 along with its spout 14 is easily contained therein. The halves are molded with a barrel stave and hoop pattern, including simulated wood grain on their outer surfaces and, preferably, molded of an economic plastic material which has sufficient rigidity to support the bag, but is resilient enough to resist breaking, such a material being polyethylene.

The rear half 18 of the shell 10, except for its open end 21, is completely closed, whereas the front half 16 has a tap or spout opening 24 in its closed end 22. The spout opening 24 is rectangular at the top, as indicated at 26, and then tapers to a smaller arcuate opening 28 at the bottom. A pair of flaps 30 and 32 are integrally molded with the half 16 and follow the outline of the spout opening 24. About midway between the flaps 30 and 32 an inverted V-shaped cut 34 is provided. The lower flap 30 is temporarily secured to the bottom of the half 16 and to the upper flap 32 by breakable tabs 36, while the upper flap 32 is pivotable on an integrally formed hinge 38. Use of the flaps 30 and 32 will be hereinafter described.

The halves 16 and 18 may be selectively joined or separated and have locking means for securing or locking the halves together. The locking means may take a variety of forms such, for example, that the two halves may be either screwed together or snapped together.

Figure 2:
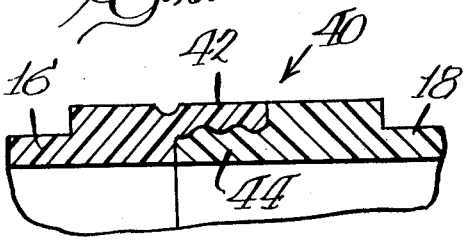
FIG. 2 is a cross-sectional view taken substantially along the line 2—2 of FIG. 1, and shows one means of locking the halves of the dispenser together.

Referring to FIG. 2, one form of locking means 40 is formed adjacent the peripheral rims or edges of the open ends 20 and 21, the edges generally lying the planes perpendicular to the longitudinal axis of the shell 10. An outer circumferential lip 42 is formed on the front half 16, while an inner circumferential lip 44, which engages and locks with the outer lip, is formed on the rear half 18. Both of the lips have depressed and raised areas or ridges which causes the halves to interlock when pressed together. The lips 42 and 44 are so formed that the halves 16 and 18 may be locked together simply by bringing them into axial alignment and then pressing them together.

Figure 3:
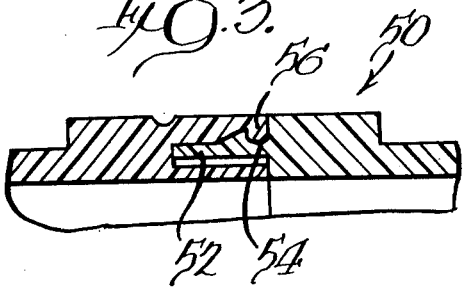
FIG. 3 is a cross-sectional view similar to FIG. 2, and shows alternative means for locking the halves together.

Referring to FIG. 3, an alternative locking means 50 comprises a hook-like lip 52 provided on one of the halves and an associated notch 54, having a radially, inwardly extending ledge 56 for receiving the hook 52, provided on the other half. The opposed sides of the notch 54 are spaced to receive the hook-like lip 52 therebetween, the hook portion being resilient so as to pass beneath the ledge and to snap into locked position behind or interiorly of the ledge.

Figure 4:
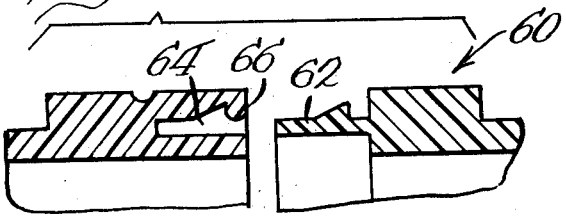
FIG. 4 is another cross-sectional view similar to FIG. 2, and shows a second alternative means for locking the halves together.

Referring to FIG. 4, another alternative locking means 60 comprises a hook-like rim 62 on one half and a receiving notch 64 with a radial lip 66 on the other half; the two being circumferentially interrupted so as to define a bayonet type of connection facilitating assembly and disassembly of the two halves by a partial twist or turn of one half relative to the other.

At the distillers the shell halves 16 and 18 are unstacked and assembled, using the locking means, about the fluent filled bag of spirits. This assembly then can be conveniently stored or shipped with little danger of breaking the bag. Further, the shell 10 forms an attractive display for the retailer.

Figure 5:
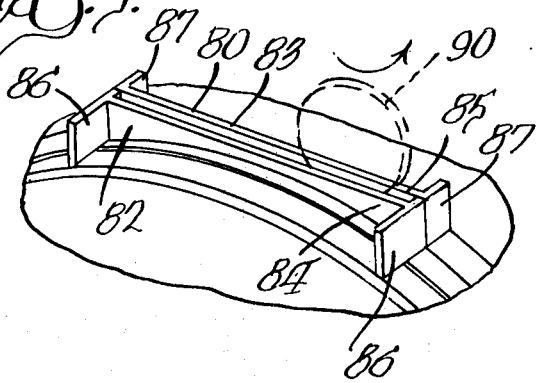
FIG. 5 is a perspective view of another portion of the dispenser shown in FIG. 1.

To prevent the barrel-shaped shell from rolling when layed on its side, as is traditional with barrels containing spirits, such as when displayed by the retailer or when placed in the refrigerator of the purchaser, and to aid in grasping the halves, means 80 (FIG. 5) are provided and accomplishes these tasks by giving the barrel shell 10 a non-circular shape. Preferably, means 80 is in the form of a pair of leg elements 82 and 83, one on each half, each leg element being integrally formed with the respective shell half and extending tangentially along the outer surface thereof. Each leg element has a central web 84 or 85 extending perpendicularly to the longitudinal axis and from which a pair of short, end webs 86 or 87 extend parallel to the longitudinal axis. In addition to prevention of rolling, the legs serve as a means of lining up the two halves before snapping them together. Also, the leg elements 82 and 83 and central webs 84 and 85 are closely spaced adjacent the open ends 20 and 21 of the halves so that a tool or coin, indicated in dotted lines at 90, can be inserted between the webs and twisted to separate the locked halves.

Figure 6:
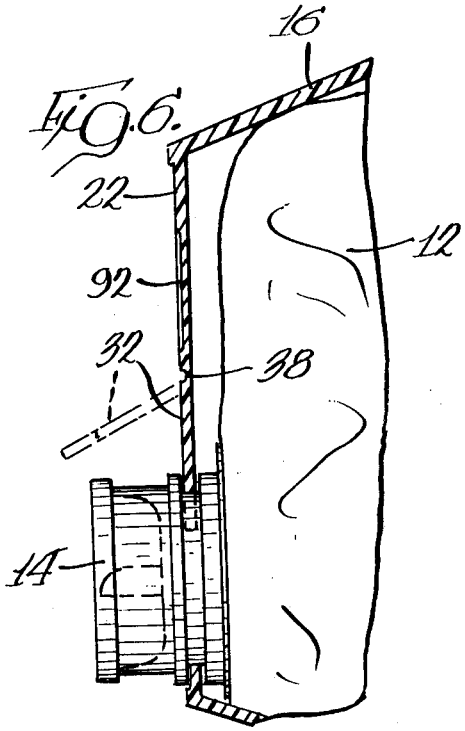
FIG. 6 is a fragmentary vertical section showing the spout of the bag removed from the interior of the barrel and associated with one end wall thereof for dispensing of the contained fluid.

Referring to FIG. 6, after purchase, the consumer merely pushes in and removes the lower flap 30; he then pulls the upper flap 32 out, withdraws the tap or spout 14 from inside the shell 10, and returns the upper flap 32 to its original position to engage the spout 14 and hold the spout securely in dispensing position. Optionally, a label may be provided and be secured on a special smooth area 92 provided on the end 22 to indicate the type spirit. The shell 10 with the bag 12 may then be placed on its side, on its legs 82 and 83 and stored in the refrigerator so that a cold beverage or spirit is available merely by operating the spout 14. Putting the barrel 10 on its side, rather than let it stand vertically, reduces the vertical height space needed to store the barrel. After the beverage in the bag 12 has been consumed, the locked shell halves 16 and 18 may be opened with the aid of a tool or coin as was described, and a full bag 12 substituted, or the separated shell halves may be utilized as bowls, flower pots, etc., as the purchaser may desire.

Although what have been shown and described are the preferred embodiments of the invention, it will be understood by those skilled in the art that changes may be made in the details thereof without departing from its scope.

What is claimed is:

1. A barrel-shaped drink dispenser comprising an outer shell formed by a pair of cup-shaped halves, each half having one closed and one open end, said halves being connectable to and separable from one another at their open ends about a plane perpendicular to the longitudinal axis of the dispenser, cooperable locking means on said halves adjacent their open ends for locking said halves together at said open ends to form a closed outer shell in the shape of a barrel, an inner flexible bag filled with fluent material and having a dispensing spout thereon, said inner flexible bag being contained within said outer shell with said spout adjacent the closed end of one said halves, said one half having an opening in its closed end adjacent said spout and including integrally formed pivotal flaps located in and normally closing said opening, said flaps being movable to accommodate access to and removal of said spout through said opening and to secure said spout in said opening in dispensing position at said one end of said shell, and a transverse leg element on each of said halves for preventing said barrel-shaped shell from rolling, each leg element having a portion adjacent the open end of the respective half adapted to be grasped to aid in separating said halves after the fluent contents of said inner bag have been dispensed.

* * * * *